United States Patent [19]

Del Bianco

[11] 4,190,931

[45] Mar. 4, 1980

[54] BRAKE ADJUSTING SPOON

[76] Inventor: Cosmo Del Bianco, 1631 E. 37th St., Brooklyn, N.Y. 11234

[21] Appl. No.: 866,503

[22] Filed: Jan. 3, 1978

[51] Int. Cl.[2] ..... B25B 13/48

[52] U.S. Cl. ..... 81/3 R

[58] Field of Search ..... 81/3 R; 254/131

[56] References Cited

U.S. PATENT DOCUMENTS 3,406,412 10/1968 Kottas ..... 81/3 R X

OTHER PUBLICATIONS

"*Mechanics Hand Tools by New Britain*", Catalog No. 59, p. 59, Brake Tools, Aug., 1961.

*Primary Examiner*—James G. Smith

*Attorney, Agent, or Firm*—Mandeville and Schweitzer

[57] ABSTRACT

A hand tool for use in adjusting a drum brake of a motor vehicle or similar mechanism. The tool comprises a member with a novel geometric configuration for the working ends. In accordance with the invention, a narrow neck portion is formed intermediate the working end and tool handle. The principal surfaces of the tool extend outwardly from the narrow neck to a wide portion and then angle down to a blade-like working end. The angled surfaces engage the wall of the drum brake such that the working end is urged into engagement with the adjusting means of the brake.

3 Claims, 3 Drawing Figures

FIG.1
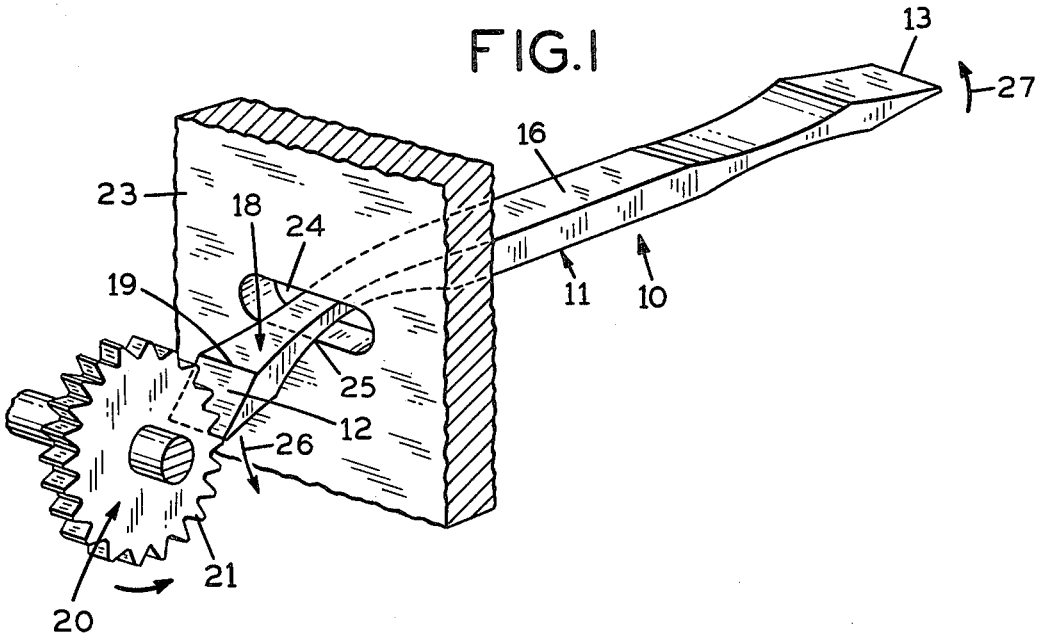
FIG.2
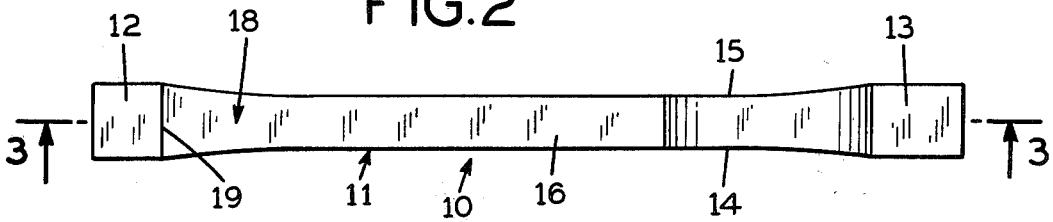
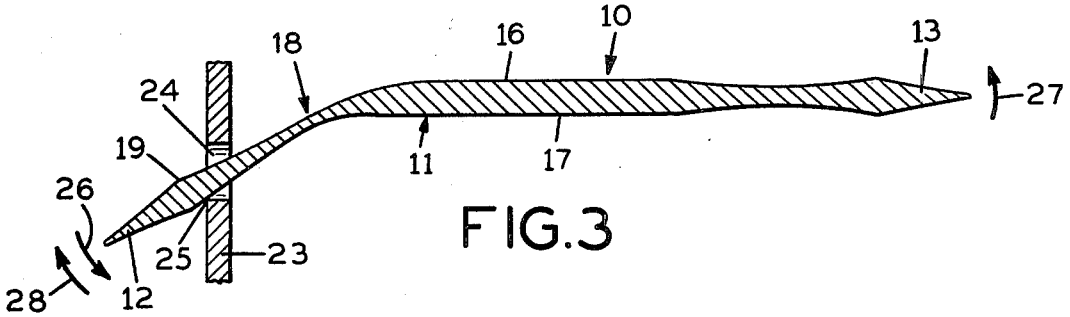
FIG.3

BRAKE ADJUSTING SPOON

BACKGROUND AND SUMMARY OF THE INVENTION

The present invention relates to a tool for adjusting a drum brake of an automobile or the like, and more particularly to a new and improved configuration for the working surfaces of a brake adjusting tool for increasing the effectiveness of the tool in engaging the adjusting means of the brake.

A drum brake for an automobile or other motor vehicle comprises a radially expandable shoe that engages the interior of a drum fixedly mounted on the wheel of the vehicle. After continuous use, the surface of the shoe wears down requiring adjustment to provide a firm engagement between the shoe and drum. To this end, a star wheel is provided to serve as an adjusting implement. Rotation of the star wheel results in movement of the shoe surface toward the drum. The star wheel is mounted within the drum structure of the brake and access is facilitated by an opening through which a tool may be inserted to engage and rotate the star wheel. It has been long recognized that currently available drum brake adjusting tools, commonly referred to as brake adjusting spoons, fall far short of being adequate to provide a reliable engagement between the tool and adjusting star wheel of a drum brake. Typically, the working end of the adjusting spoon is formed to the shape of a conventional screw driver. The working end of the spoon is inserted through the opening in the drum wall and the tool is pivoted about the wall at a point on the opening by manipulating the tool handle whereby a downward movement is imparted to the working end to thereby rotate the star wheel.

A common problem associated with the above-described prior art tool is slippage. It is difficult for a mechanic to engage the star wheel and manipulate the tool without the working end slipping out of engagement with the star wheel. Moreover, it is often difficult for the mechanic to discern whether or not the tool rotated the star wheel or has slipped. Thus, adjusting a drum brake is often a tedious job due to the inadequacies of the prior adjusting spoons.

It is a primary objective of the present invention to provide a brake adjusting tool which overcomes the abovedescribed problems and which is of a rugged, inexpensive construction. Generally, the novel tool disclosed herein comprises a single member tool with a unique working end geometry which coacts with the drum brake structure to insure engagement with and rotation of the adjusting star wheel. In one advantageous form of the invention, the working end includes angled surfaces. The tool contacts the wall of the drum brake in such a manner whereby the angled surfaces urge the working end into engagement with the star wheel. Manipulation of the tool tends to further drive the working end into engagement to assure rotation of the adjusting wheel.

More specifically, the handle of the tool is formed to a narrow neck portion proximate to the working end. A portion of each of the principal surfaces of the tool is disposed at an incline. The inclined portions extend outwardly to a wide portion intermediate the neck and working end and thereafter angle toward one another to a thin blade-like working end. The dimensions of the tool are arranged such that the wide portion is just within the confines of the drum brake structure when the blade-like working end is in engagement with the star wheel. Consequently, the inclined surfaces will contact the opening of the drum wall and thereby tend to urge the working end further into engagement with the star wheel by counter-acting the natural tendency of the end to slip down and out of engagement.

These and other features and advantages of the present invention will become apparent from a reading of the following detailed description of a preferred embodiment and the accompanying drawings.

BRIEF DESCRIPTION OF THE DRAWINGS

FIG. 1 is an isometric view of the brake adjusting tool of the present invention as utilized to rotate an adjusting wheel.

FIG. 2 is a top plan view of the tool of FIG. 1.

FIG. 3 is a side cross-sectional view of the tool taken along line 3—3 of FIG. 2 and illustrating the contacting relationship between the narrow neck of the tool and wall of a drum brake structure or the like.

DETAILED DESCRIPTION OF A PREFERRED EMBODIMENT

Referring now to the drawings, there is illustrated a brake adjusting spoon built in accordance with the teachings of the present invention and designated generally by the reference numeral 10. The spoon 10 includes a handle 11 and two working ends 12, 13. The working ends 12, 13 are of a blade-like configuration. To advantage, the working end 12 lies in a plane at an angle to the plane occupied by the handle 11 while the working end 13 is within the same plane as the handle 11. This increases the versatility of the tool by allowing two angles of engagement with the drum brake. The particular working end is selected according to the elevation of the motor vehicle when it is being worked upon.

In accordance with the invention, there is provided a unique geometric arrangement for the portions of the tool 10 extending between the handle 11 and each of the blade-like working ends 12, 13. As reflected in FIG. 1, the tool 10 comprises a single three-dimensional body with side portions 14, 15 and opposed principal surfaces 16, 17. Except for the angled relation between the working end 12 and handle 11, both ends of the tool 10 are substantially similar and the detailed description will be continued with respect to working end 12 only.

A neck portion 18 is formed by a concave contour in each of the opposed principal surfaces 16, 17. The neck portion 18 terminates at an area 19 spaced from the working end 12. The principal surfaces 16, 17 are angled from the area 19 to a thin, blade-like working end 12. The resultant structure is a unique geometry of angled surfaces between the handle 11 and each of the working ends 12, 13.

Referring now particularly to FIG. 1, there is illustrated the tool 10 of the present invention as applied to the adjustment of a drum brake of an automobile or similar motor vehicle. Of course, it should be recognized that the tool 10 may also be utilized in other similar applications. A star wheel 20 is arranged to adjust the shoe (not shown) of a conventional drum brake in a well known manner. The tool 10 is inserted through an opening 24 formed through the outer wall 23 of the drum brake. The working end 12 is guided into engagement between the teeth 21 of the star wheel 20. The dimensions of the tool are arranged such that the area 19 is just within the confines of the drum structure when the working end 12 engages the star wheel 20. Significantly, the contoured neck portion 18 will contact the wall 23 at the opening 24 as indicated by the reference numeral 25. As the tool 10 is pivoted by the user to impart a downward movement to the working end 12, as indicated by the arrows 26, 27 in FIG. 3, the angled contour of the neck portion 18 will urge the end 12 in the direction indicated by arrow 28. The resulting motion of the working end 12 will tend to follow an outwardly diverging arcuate path. Consequently, slippage out of engagement with the star wheel 20 will be prevented.

Thus, the present invention provides a highly advantageous and entirely practical tool for adjusting a drum brake. A proper engagement between the tool end and adjusting means is virtually assured. At the same time, the tool affords an inexpensive manufacturing method. The tool may be made in a simple molding operation from a high strength metal. The tool is convenient to handle, store and is durable and long lasting. The unique geometry of the working ends takes full advantage of the spacial relationship between the adjusting wheel of the drum brake and outer wall of the enclosing structure to provide a reliable and effective working action.

It should be understood, of course, that the particular form of the invention described and illustrated herein is intended to be representative only, as certain changes may be made therein without departing from the clear teachings of the invention. Accordingly, reference should be made to the following appended claims in determining the full scope of the invention.

I claim:

1. A tool for adjusting a rotatable means in a drum brake structure or the like, which comprises (a) a longitudinally elongated, three-dimensional body having a predetermined width dimension, (b) a relatively thin blade-like working end integral with at least one end of said body, (c) said body including principal top and bottom surfaces generally spaced from one another said predetermined width and angled toward one another from an area of the body adjacent the working end to the thin blade-like working end, and (d) a portion of at least one of said principal surfaces being formed to include an area disposed at an incline to the remaining portions of said one principal surface, (e) said inclined portion forming an angle to the remaining portions of said one principal surface, which angle is at a slant reversely beveled with respect to the angled area of said one principal surface adjacent the working end, (f) said working end being arranged for insertion through an opening in said drum brake structure for engagement with said rotatable adjusting means, (g) said inclined portion of said one principal surface being arranged and configured whereby the inclined portion engages the drum brake structure adjacent said opening when the working end is in engagement with said rotatable means, thereby urging the working end further into engagement.

2. The tool of claim 1, further characterized by (a) said body including two blade-like working ends each integral therewith.

3. The tool of claim 2, further characterized by (a) one of said working ends being angularly disposed with respect to said body.

* * * * *